US010431373B2

(12) United States Patent
Narayanan et al.

(10) Patent No.: US 10,431,373 B2
(45) Date of Patent: Oct. 1, 2019

(54) COUPLED INDUCTOR

(71) Applicant: Würth Elektronik eiSos GmbH & Co. KG, Waldenburg (DE)

(72) Inventors: Raghu Narayanan, Dracut, MA (US); Dheeraj Jain, Murphy, TX (US); Oliver Opitz, Kirchheim (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 39 days.

(21) Appl. No.: 15/257,497

(22) Filed: Sep. 6, 2016

(65) Prior Publication Data

US 2018/0068778 A1 Mar. 8, 2018

(51) Int. Cl.
*H01F 27/28* (2006.01)
*H01F 3/14* (2006.01)
*H01F 27/30* (2006.01)

(52) U.S. Cl.
CPC ..... *H01F 27/2852* (2013.01); *H01F 3/14* (2013.01); *H01F 27/306* (2013.01); *H01F 27/2847* (2013.01)

(58) Field of Classification Search
CPC ..... H01F 27/2852; H01F 27/306; H01F 27/2847; H01F 27/24; H01F 27/29; H01F 2027/2857; H01F 2027/2861; H01F 3/14
USPC ..... 336/212, 220–222, 192
See application file for complete search history.

(56) References Cited

U.S. PATENT DOCUMENTS 6,545,450 B1 4/2003 Ledenev et al.
6,686,727 B2 2/2004 Ledenev et al.
6,696,823 B2 2/2004 Ledenev et al.
6,817,085 B2 11/2004 Uchikoba et al.
7,295,092 B2 11/2007 Elliott et al.
8,890,644 B2 11/2014 Ikriannikov
9,336,941 B1 * 5/2016 Ikriannikov ..... H01F 27/29
2011/0169476 A1 7/2011 Ikriannikov et al.
(Continued)

FOREIGN PATENT DOCUMENTS

TW 200933662 8/2009

OTHER PUBLICATIONS

Cooper Bussmann, Coiltronics, "Multi-Phase Power Inductors", St. Louis, MO, published 2010, pp. 1-5.
(Continued)

*Primary Examiner* — Mang Tin Bik Lian
(74) *Attorney, Agent, or Firm* — Boyle Fredrickson, S.C.

(57) ABSTRACT

The invention refers to a coupled inductor having a core and two windings, wherein the first winding has a first and a second terminal end and wherein the second winding has a third and a fourth terminal end, wherein the first to fourth terminal ends are arranged on a lower side of the core, wherein each winding has an intermediate section extending through a through-hole in the core, wherein the two windings are designed at least in the intermediate section as flat stripes each having first and second side faces with a large width and third and fourth side faces having a small width compared to the width of the first and second side faces, wherein the first side faces of both windings are arranged in the intermediate section perpendicular to the lower side of the core and wherein the two first side faces of the windings in the intermediate section face each other and/or abut each other in the intermediate section.

10 Claims, 2 Drawing Sheets

(56) References Cited

U.S. PATENT DOCUMENTS

| | | | | |
|---|---|---|---|---|
| 2011/0279212 | A1* | 11/2011 | Ikriannikov | ..... H01F 17/0006 336/192 |
| 2013/0127434 | A1 | 5/2013 | Ikriannikov | |
| 2014/0266552 | A1 | 9/2014 | Silva et al. | |

OTHER PUBLICATIONS

Ice Components, "ICL701-1 VRD/POL Inductor", www.icecomponents.com, published Nov. 2011, pp. 1-2.
Pulse Electronics, "SMT Power Inductors", San Diego, CA, www.pulseelectronics.com, Copyright 2012, pp. 1-2.

* cited by examiner

COUPLED INDUCTOR

TECHNICAL FIELD

The invention refers to a coupled inductor having a core and two windings.

BACKGROUND SUMMARY

The underlying problem of the invention is to improve a coupled inductor having a core and two windings.

To this end, a coupled inductor having a core and two windings is provided, wherein the first winding has a first and second terminal end and wherein the second winding has a third and fourth terminal end, wherein the first to fourth terminal ends are arranged on a lower side of the core, wherein each winding has an intermediate section extending through a through-hole in the core, wherein the two windings are designed at least in the intermediate section as flat stripes each having first and second side faces with a large width and third and fourth side faces having a small width compared to the width of the first and second side faces, wherein the first side faces of both windings are arranged in the intermediate section perpendicular to the lower side of the core and wherein the two first side faces of the windings in the intermediate section face each other and/or abut each other in the intermediate section.

Surprisingly, arranging the first larger side faces of stripe-shaped windings in the intermediate section perpendicular to the lower side of the core significantly improves the electric and magnetic properties of the proposed coupled inductor. The placement of the stripe-shaped windings in the intermediate section in this fashion, i.e. with the narrow side faces directed upwards and downwards, respectively, and with the larger side faces to the left and to the right, respectively, helps the inductor to utilize almost its full volume of core material when operating. As a consequence, the size of the core and the coupled inductor can be made less than half than known coupled inductors.

According to an embodiment of the invention the core is divided in at least two parts being connected to each other.

This enables easy manufacture of the inventive coupled inductor. A distance between the two parts of the core can be precisely controlled by, e.g., putting a wire having a defined diameter or small glass balls with a defined diameter between the two parts of the core when connecting the two parts of the core. Connecting of the two parts of the core can, e.g., be achieved by gluing, e.g. by means of an epoxy resin.

According to an embodiment of the invention a parting plane between the two parts extends parallel to the lower side of the core. In this way easy manufacture of the inventive coupled inductor can be achieved.

According to an embodiment of the invention at least one of the parts of the core has a U-shape and defines a channel for accommodating the intermediate section of the two windings.

By providing a part of the core in a U-shape, the intermediate sections of the windings can be arranged in an easy and precise way, since the U-shaped part will provide for an exact location of the intermediate sections.

According to an embodiment of the invention a first part of the two parts of the core has the shape of a cuboid and a second one of the two parts of the core is U-shaped.

In this way, two simply shaped parts can form the core. The cuboid shaped part of the core can be easily attached to the U-shaped part, thereby fixing the intermediate section of the windings within the core.

According to an embodiment of the invention a parting plane between the two parts of the core extends from the lower to the upper side of the core and sections of the two windings are arranged between the two parts of the core.

Arranging the parting plane between the two parts of the core in this way makes assembly of the inventive coupled inductor even easier. The two parts of the core are brought together and the first winding and the second winding are arranged with their intermediate sections inbetween the two parts of the core.

According to an embodiment of the invention the through-hole in the core is formed by at least one groove being arranged in the side faces of the two parts of the core facing each other.

In this fashion, the through-hole is completed when the two parts of the core abut each other.

According to an embodiment of the invention the side face of each of the two parts of the core comprises a groove, the two grooves forming the through-hole. Each of the two parts of the core, therefore, has a groove which, in the assembled part of the core, forms part of the through-hole. Advantageously, the grooves are adapted to the size and shape of the intermediate sections of the windings. Thereby, the intermediate section of a winding can be placed within the groove and is thereby fixed in place. The two parts of the core with the winding already be placed in the groove can then be simply put together to complete the coupled inductor.

According to an embodiment of the invention the core has a front side and a back side, wherein the intermediate sections of the windings between the two parts of the core extend between the front side and the back side of the core and wherein the windings have sections being arranged parallel to the front side and the back side of the core.

In this way, the two windings can be easily fixed to the core and only little room is needed for the finished coupled inductor. The core may have grooves or recesses for accommodating the sections of the windings being arranged parallel to the front side and the back side of the core, respectively.

According to an embodiment of the invention the terminal ends are connected to the sections of the windings being arranged parallel to the front side and the back side of the core.

In this way, a very compact arrangement is achieved.

According to an embodiment of the invention the sections being arranged parallel to the front side and the back side of the core are arranged perpendicular to the intermediate sections and perpendicular to the parting plane.

According to an embodiment of the invention at least the first side faces of the windings in the intermediate sections between the two parts of the core are coated with an electrically isolating layer.

Further features and advantages of the invention follow from the claims, the drawings and the description as follows. Individual features of the different embodiments can be combined without departing from the scope of this invention.

DETAILED DESCRIPTION

Figure 1:
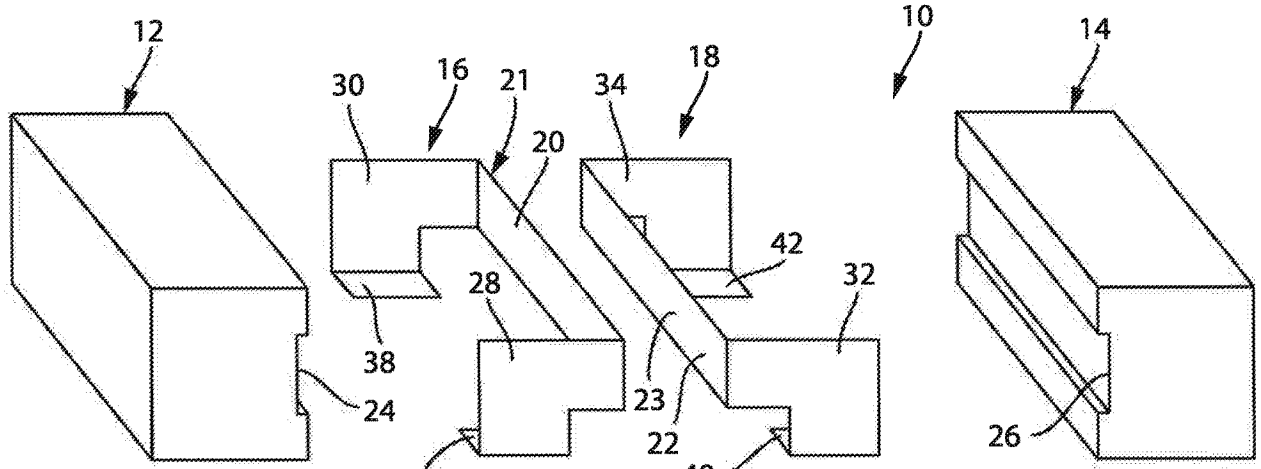
FIG. 1 shows a schematic exploded view of a coupled inductor according to a first embodiment of the invention.

FIG. 1 shows a coupled inductor 10 according to a first embodiment of the invention in an exploded view i.e. before assembling the coupled inductor 10. The coupled inductor 10 comprises a first part 12 and a second part 14 of a core. The core is made of ferrite material.

The coupled inductor further comprises a first winding 16 and a second winding 18. As can be seen in FIG. 1, the two windings 16, 18 are identical to each other. Also, the two parts 12, 14 of the core are identical to each other.

Each winding 16, 18 has an intermediate section 20, 22, wherein each intermediate section 20, 22 has the shape of a flat stripe. Each intermediate section, therefore, has first and second side faces with a large width. These are the side faces of the intermediate sections 20, 22 facing to the left and to the right in FIG. 1, respectively. Further, each intermediate section 20, 22 has third and fourth side faces having a small width compared to the width of the first and second side faces. In FIG. 1, the third and fourth side faces of the intermediate sections 20, 22 face the upper side and the lower side in FIG. 1, respectively.

The two parts 12, 14 of the core generally have cuboid shape and each comprise a groove 24, 26 in a side face thereof which extends from the front side of the two parts 12, 14 of the core to the back side thereof. The grooves 24, 26 have a length which is approximately equal to the length of the intermediate sections 20, 22. The grooves 24, 26 each have a width which is only slightly larger than the width of the intermediate sections 20, 22, i.e. the distance between the third and fourth side faces of the intermediate sections 20, 22. In other words, the grooves 24, 26 are shaped to accommodate the intermediate sections 20, 22 of the windings 16, 18. When the two parts 12, 14 of the core are assembled to form the core, the two grooves 24, 26 together form a through-hole which extends from the front side to the back side of the core.

Figure 2:
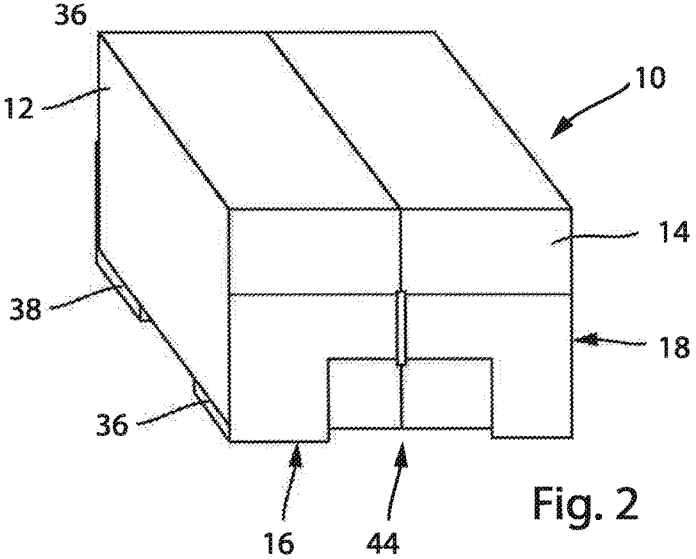
FIG. 2 shows the coupled inductor of FIG. 1 in an assembled state.

The two windings 16, 18 further have sections 28, 30, 32 and 34 which are arranged perpendicularly to the intermediate sections 20, 22 and which, in the assembled state of the coupled inductor, see FIG. 2, are arranged parallel to the front side and the back side of the core, respectively.

Further, each winding 16, 18 has two terminal ends. The first winding 16 has a first terminal end 36 and a second terminal end 38. The second winding has a first terminal end 40 and a second terminal end 42. The terminal ends 36, 38 are arranged perpendicularly to the sections 28, 30 and also perpendicularly to the intermediate section 20 of the winding 16.

The winding 18 has a third terminal end 40 and a fourth terminal end 42, the terminal ends 40, 42 being arranged perpendicularly to the sections 32, 34 and being also arranged perpendicularly to the intermediate section 22.

The first to fourth terminal ends 36, 38, 40, 42 are arranged on a lower side of the core in the assembled state thereof, see FIG. 2.

The side faces of the intermediate sections 20, 22 which face each other are coated with respective electrically isolating layers 21, 23. As a consequence, even when the intermediate sections 20, 22 touch each other in the assembled state of the coupled inductor 10, see FIG. 2, there will be no electrical contact between the two windings 16, 18.

FIG. 2 shows the coupled inductor 10 according to the first embodiment of the invention in the assembled state. The two parts 12, 14 of the core have now been brought together and have also been fixed together. This can, e.g., be achieved by gluing the two parts 12, 14 of the core together, e.g. by means of an epoxy glue. A parting plane 44 between the two parts 12, 14 of the core then extends from a lower side of the core to an upper side of the core. Since the two parts 12, 14 of the core are identically shaped, the parting plane 44 also forms a mid-plane or symmetry plane of the coupled inductor 10.

It can be seen in FIG. 2 that the terminal ends 36 and 38 of the winding 16 are arranged on a lower side of the core. Equally, the terminal ends 40, 42 of the winding 18 are also arranged on a lower side of the core; however, they cannot be seen in FIG. 2.

To ensure a predefined width of a gap between the two parts 12, 14 of the core in the area of the parting plane 44, glass balls with an exactly defined diameter or pieces of a wire with an exactly defined diameter can be arranged between the two parts of the core 12, 14 and can be embedded in glue when fixing the two parts 12, 14 together. In the area of the parting plane 44 a gap between the intermediate sections 20, 22 of the windings 16, 18 can also be filled with glue.

It can be seen in FIG. 2 that the inventive coupled inductor 10 is very compact. Further, designing the intermediate sections 20, 22 of the windings 16, 18 as flat stripes and arranging the intermediate sections 20, 22 so that the two larger first side faces of the windings in the intermediate section are arranged perpendicularly to the lower side of the core helps the coupled inductor to utilize almost the full volume of its core when operating. This in turn helps to make its size less than half of other, conventional coupled inductors.

Figure 3:
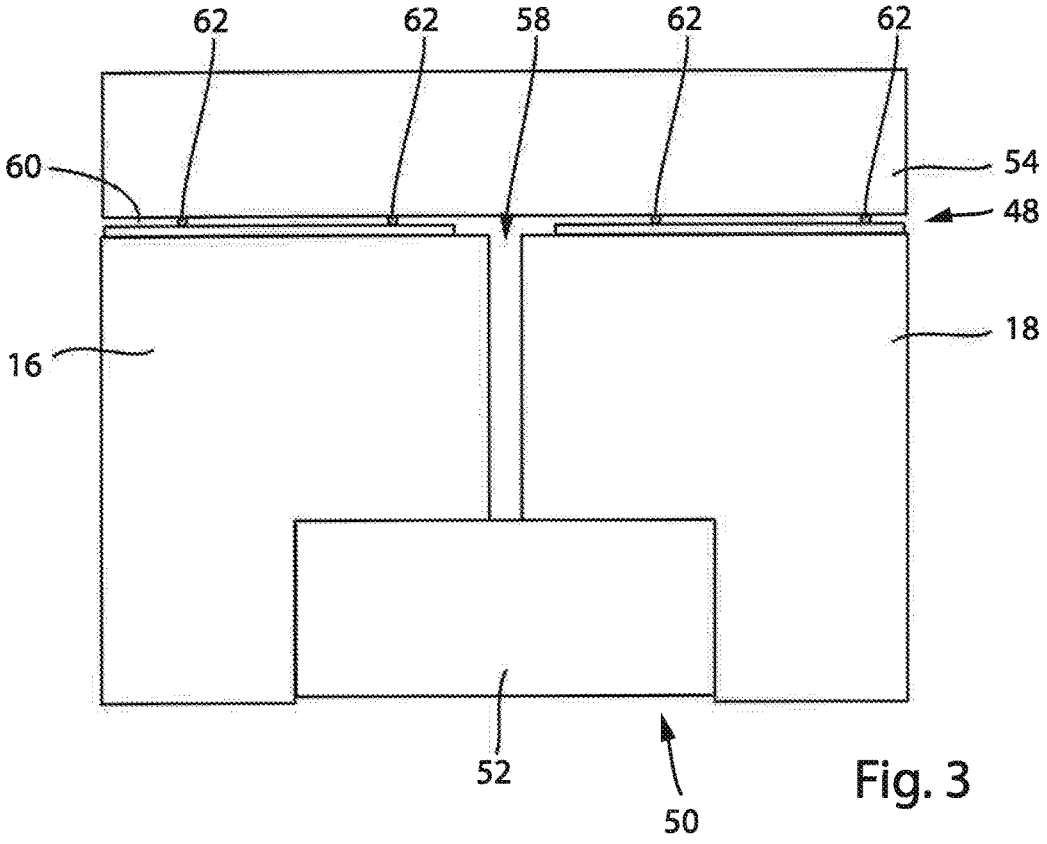
FIG. 3 shows a schematic front view of a coupled inductor according to a second embodiment of the invention and FIG. 4 shows a schematic front view of one of the two parts of the core of the coupled inductor of FIG. 3.

FIG. 3 shows a coupled inductor 50 according to a second embodiment of the invention. The windings 16, 18 are identical to the windings 16, 18 of the coupled inductor 10 according to FIG. 1 and FIG. 2.

Figure 4:
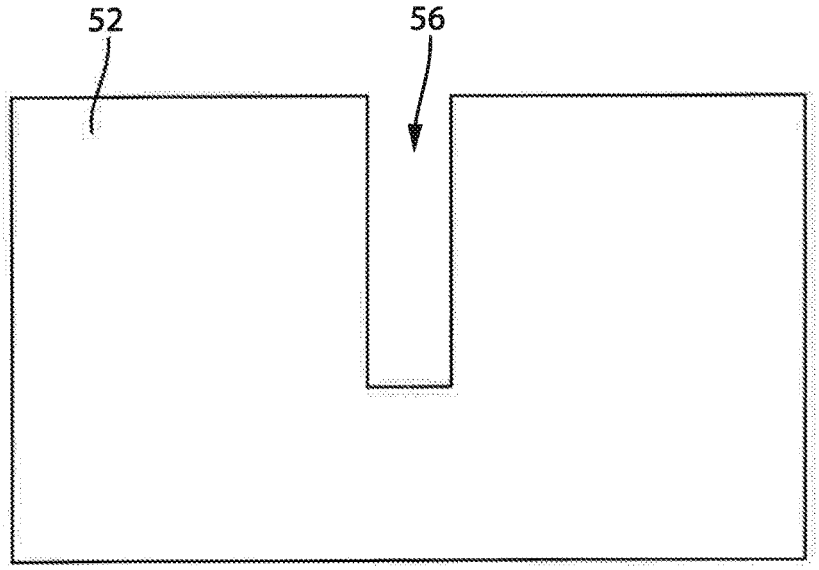

The core of the coupled inductor 50 comprises two parts 52, 54. The first part 52 of the core has a U-shape, a front view of the first part 52 being shown in FIG. 4. The first part 52 comprises a central groove 56, which extends from the front side to the back side of the part 52 and which is adapted to accommodate the intermediate sections 20, 22 of the windings 16, 18. As can be seen in FIG. 3, in the assembled state of the coupled inductor 50 a gap 58 exists between the side faces of the intermediate sections of the windings 16, 18. This gap 58 helps to prevent an electrical contact between the windings 16, 18. A parting plane 48 between the two parts 52, 54 extends parallel to the lower side of the core.

As a consequence, the width of the groove 56 is slightly wider than twice the width of the intermediate sections 20, 22 of the windings 16, 18.

The second part 54 of the core has a cuboid shape. The second part 54 is simply put on top of the first part 52. Thereby, the groove 56 in the first part 52 is closed and a through-hole through the core is formed.

As can be seen in FIG. 3, a gap 60 exists between the first part 52 and the second part 54 of the core. To ensure a constant height of this gap 60 on the left side of the core and of the right side of the core in FIG. 3, pieces 62 of a wire having a predefined diameter with very low tolerances are arranged in between the two parts 52, 54 of the core. When the two parts 52, 54 of the core are glued together, the wire pieces 62 remain in place.

The invention claimed is:

1. Coupled inductor having a core and two windings, wherein a first winding has a first and second terminal end and wherein a second winding had a third and fourth terminal end, wherein the first to fourth terminal ends are arranged on a lower side of the core, wherein each winding has an intermediate section extending through a through hole in the core, wherein the two windings are designed at least in the intermediate section as flat stripes each having first and second side faces with a large width and third and fourth side faces having a small width compared to the width of the first and second side faces, wherein the first side laces of both windings are arranged in the intermediate section perpendicular to the lower side of the core and wherein the two first side faces of the windings in the intermediate section face each other and/or abut each other in the intermediate section, wherein the core has a front side surface and a backside surface, wherein the intermediate sections of the windings continuously extends from the front side surface to the back side surface of the core, and wherein the windings have sections arranged parallel to the front side surface and the back side surface of the core, wherein the terminal ends are connected to the sections of the windings.

2. Coupled inductor according to claim 1, wherein the core is divided in at least two parts being connected to each other.

3. Coupled inductor according to claim 2, wherein, a parting plane between the two parts extends parallel to the lower side of the core.

4. Coupled inductor according to claim 3, wherein at least one of the parts of the core has a u-shape defining a groove for accommodating the intermediate sections of the two windings.

5. Coupled inductor according to claim 4, wherein a second part of the two parts of the core has the shape of a cuboid and wherein a first one of the two parts of the core is unshaped.

6. Coupled inductor according to claim 2, wherein a parting plane between the two parts extends from the lower to the upper side of the core and wherein intermediate sections of the two windings are arranged between the two parts of the core.

7. Coupled inductor according to claim 6, wherein the through hole in the core is formed by at least one groove being arranged in the side faces of the two parts of the core facing each other.

8. Coupled inductor according to claim 7, wherein the two side faces of the two parts of the core facing each other each comprise a groove, the two grooves forming the through hole.

9. Coupled inductor according to claim 1, wherein the sections being arranged parallel to the front side and the back side of the core are arranged perpendicular to the intermediate sections and perpendicular to the parting plane.

10. Coupled inductor according to claim 1, wherein at least the first side faces of the windings in the intermediate sections, said first side faces facing each other, are coated with an electrically isolating layer.

* * * * *